US008843009B2

(12) United States Patent
Yogosawa et al.

(10) Patent No.: US 8,843,009 B2
(45) Date of Patent: Sep. 23, 2014

(54) IMAGE FORMING APPARATUS HAVING A TRANSFER MEMBER MOUNT ACCOMMODATING MULTIPLE DIFFERENT SIZES OF TRANSFER MEMBERS

(75) Inventors: Kazuki Yogosawa, Tokyo (JP); Nobuto Yokokawa, Kanagawa (JP); Satoru Uchida, Kanagawa (JP); Takeshi Fukao, Kanagawa (JP); Takuya Sekine, Kanagawa (JP); Hiroki Matsuura, Kanagawa (JP); Masakazu Imai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 182 days.

(21) Appl. No.: 13/571,875

(22) Filed: Aug. 10, 2012

(65) Prior Publication Data

US 2013/0051828 A1 Feb. 28, 2013

(30) Foreign Application Priority Data

Aug. 22, 2011 (JP) ..... 2011-180769
Jul. 4, 2012 (JP) ..... 2012-150661

(51) Int. Cl.
*G03G 15/16* (2006.01)
*G03G 15/00* (2006.01)

(52) U.S. Cl.
CPC ..... *G03G 15/5058* (2013.01)
USPC ..... 399/66; 399/45; 399/121

(58) Field of Classification Search
CPC ..... G03G 15/5058; G03G 2215/16; G03G 2221/1642
USPC ..... 399/66, 121, 45
See application file for complete search history.

(56) References Cited

U.S. PATENT DOCUMENTS

| | | | |
|---|---|---|---|
| 5,598,254 | A | 1/1997 | Ikesue et al. |
| 5,606,408 | A | 2/1997 | Yano et al. |
| 5,619,316 | A | 4/1997 | Shoji et al. |
| 5,638,159 | A | 6/1997 | Kai et al. |

(Continued)

FOREIGN PATENT DOCUMENTS

| | | |
|---|---|---|
| JP | 2003-248361 | 9/2003 |
| JP | 2007-133191 | 5/2007 |
| JP | 2007-334011 | 12/2007 |
| JP | 2008-090015 | 4/2008 |

OTHER PUBLICATIONS

U.S. Appl. No. 13/412,174, filed Mar. 5, 2012, Hiroki Matsuura, et al.

*Primary Examiner* — Susan Lee
(74) *Attorney, Agent, or Firm* — Oblon, Spivak, McClelland, Maier & Neustadt, L.L.P.

(57) ABSTRACT

An image forming apparatus includes an image forming mechanism, an image bearing member, a transfer member, a transfer member mount, and an image detector. The image forming mechanism forms a first image and a second image on a surface of the image bearing member. The transfer member is disposed facing the image bearing member and contactable thereagainst to form a transfer nip at which the first image is transferred from the image bearing member to a recording medium. The transfer member mount on which the transfer member is disposed accommodates multiple different sizes of transfer member. The image detector detects the second image on the surface of the image bearing member. The image forming apparatus includes a plurality of interchangeable transfer members, only one of which at any given time faces the image bearing member, and a transfer member switching device to switch between the plurality of transfer members.

13 Claims, 9 Drawing Sheets

(56) References Cited

U.S. PATENT DOCUMENTS

| | | | | |
|---|---|---|---|---|
| 5,774,772 | A | 6/1998 | Kai et al. | |
| 5,870,650 | A | 2/1999 | Takahashi et al. | |
| 5,915,155 | A | 6/1999 | Shoji et al. | |
| 5,983,060 | A | 11/1999 | Namekata et al. | |
| 5,999,773 | A | 12/1999 | Yasutomi et al. | |
| 6,035,157 | A | 3/2000 | Takahashi et al. | |
| 6,125,243 | A | 9/2000 | Shoji et al. | |
| 6,167,230 | A | 12/2000 | Kimura et al. | |
| 6,295,438 | B1 | 9/2001 | Fujishiro et al. | |
| 6,445,900 | B2 | 9/2002 | Fukao et al. | |
| 7,430,385 | B2 * | 9/2008 | Yamaoka | |
| 7,953,335 | B2 * | 5/2011 | Kuwabara et al. | 399/66 |
| 8,254,811 | B2 * | 8/2012 | Andoh et al. | 399/121 |
| 8,588,641 | B2 * | 11/2013 | Mimbu et al. | 399/121 |
| 2003/0219287 | A1 | 11/2003 | Ogiyama et al. | |
| 2004/0013451 | A1 | 1/2004 | Fukao et al. | |
| 2004/0164691 | A1 | 8/2004 | Andoh et al. | |
| 2005/0047816 | A1 | 3/2005 | Uchida et al. | |
| 2005/0053388 | A1 | 3/2005 | Yokoyama et al. | |
| 2005/0057209 | A1 | 3/2005 | Andoh et al. | |
| 2005/0085945 | A1 | 4/2005 | Andoh et al. | |
| 2005/0238372 | A1 | 10/2005 | Shinohara et al. | |
| 2006/0110189 | A1 | 5/2006 | Matsuda et al. | |
| 2006/0133873 | A1 | 6/2006 | Andoh et al. | |
| 2006/0153604 | A1 | 7/2006 | Matsuda et al. | |
| 2006/0165442 | A1 | 7/2006 | Kobayashi et al. | |
| 2006/0182471 | A1 | 8/2006 | Okamura et al. | |
| 2006/0210307 | A1 | 9/2006 | Katoh et al. | |
| 2006/0210324 | A1 | 9/2006 | Kuma et al. | |
| 2006/0216057 | A1 | 9/2006 | Fukao | |
| 2006/0284958 | A1 | 12/2006 | Saeki et al. | |
| 2007/0098472 | A1 | 5/2007 | Saeki et al. | |
| 2007/0127947 | A1 | 6/2007 | Kuma et al. | |
| 2007/0127955 | A1 | 6/2007 | Katoh et al. | |
| 2007/0189815 | A1 | 8/2007 | Andoh et al. | |
| 2007/0231022 | A1 | 10/2007 | Yokoyama et al. | |
| 2007/0248391 | A1 | 10/2007 | Yokokawa et al. | |
| 2007/0286640 | A1 | 12/2007 | Katoh et al. | |
| 2008/0112734 | A1 | 5/2008 | Furuya et al. | |
| 2008/0118281 | A1 | 5/2008 | Saeki et al. | |
| 2008/0145102 | A1 | 6/2008 | Katoh et al. | |
| 2008/0175619 | A1 | 7/2008 | Katoh et al. | |
| 2008/0175621 | A1 | 7/2008 | Furuya et al. | |
| 2009/0003864 | A1 | 1/2009 | Yamaguchi et al. | |
| 2009/0169236 | A1 | 7/2009 | Fukao et al. | |
| 2009/0257799 | A1 | 10/2009 | Haruno et al. | |
| 2009/0279906 | A1 | 11/2009 | Kuma et al. | |
| 2009/0297238 | A1 | 12/2009 | Matsuura et al. | |
| 2009/0317104 | A1 | 12/2009 | Katoh et al. | |
| 2010/0003051 | A1 | 1/2010 | Sekina et al. | |
| 2010/0008696 | A1 | 1/2010 | Furuya et al. | |
| 2010/0061752 | A1 | 3/2010 | Sudo et al. | |
| 2010/0067952 | A1 | 3/2010 | Fujita et al. | |
| 2010/0080625 | A1 | 4/2010 | Furuya et al. | |
| 2011/0058859 | A1 | 3/2011 | Nakamatsu et al. | |
| 2011/0103862 | A1 | 5/2011 | Saeki et al. | |
| 2011/0150540 | A1 | 6/2011 | Saeki et al. | |
| 2011/0206432 | A1 | 8/2011 | Ninomiya et al. | |
| 2011/0211855 | A1 | 9/2011 | Kogure et al. | |
| 2011/0229195 | A1 | 9/2011 | Matsuura | |
| 2011/0255910 | A1 | 10/2011 | Sekine | |
| 2012/0020698 | A1 | 1/2012 | Fukao | |
| 2012/0189332 | A1 | 7/2012 | Fukao | |

* cited by examiner

IMAGE FORMING APPARATUS HAVING A TRANSFER MEMBER MOUNT ACCOMMODATING MULTIPLE DIFFERENT SIZES OF TRANSFER MEMBERS

CROSS-REFERENCE TO RELATED APPLICATIONS

This patent application is based on and claims priority pursuant to 35 U.S.C. §119 from Japanese Patent Application Nos. 2011-180769, filed on Aug. 22, 2011, and 2012-150661, filed on Jul. 4, 2012, both in the Japan Patent Office, which are hereby incorporated by reference herein in their entirety.

BACKGROUND OF THE INVENTION

1. Field of the Invention

Exemplary aspects of the present invention generally relate to an image forming apparatus, and more particularly, to an image forming apparatus including a transfer device that transfers a toner image formed on an image bearing member to a recording medium.

2. Description of the Related Art

Related-art image forming apparatuses, such as copiers, facsimile machines, printers, or multifunction printers having at least one of copying, printing, scanning, and facsimile capabilities, typically form an image on a recording medium according to image data. Thus, for example, a charger uniformly charges a surface of an image bearing member (which may, for example, be a photosensitive drum); an optical writer projects a light beam onto the charged surface of the image bearing member to form an electrostatic latent image on the image bearing member according to the image data; a developing device supplies a single-component or a two-component developer to the electrostatic latent image formed on the image bearing member to render the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

Known image forming apparatuses employ an intermediate transfer method in which toner images formed on one or a plurality of photosensitive members serving as a first image bearing member are transferred onto an intermediate transfer member serving as a second image bearing member so that the toner images are superimposed one atop the other, forming a composite toner image in a process known as primary transfer. Subsequently, the composite toner image on the intermediate transfer member is transferred onto a recording medium such as a sheet of paper, in a process known as secondary transfer.

A transfer device employed in such image forming apparatuses that transfers the toner image from the image bearing member such as the photosensitive member and the intermediate transfer member onto the recording medium often employs a roller-type transfer member that contacts the image bearing member, thereby forming a transfer nip therewith through which the recording medium passes and the toner image on the image bearing member is transferred thereon as the recording medium passes.

It is known that in the image forming apparatuses equipped with such a transfer device, toner tends to be supplied excessively to the image bearing member in a low-temperature, low-humidity environment at the start-up of the image forming apparatus. As a result, the toner sticks undesirably to a non-image formation area or a background portion of the image bearing member. When this occurs, the toner adhering to the non-image formation area or the background portion of the image bearing member migrates to the transfer member, resulting in contamination of the transfer member. The non-image formation area herein refers to an area other than an area where an image is formed.

In order to prevent contamination of the transfer member and the recording medium by toner, JP-2007-133191-A proposes use of a parting agent that enhances separation of toner from the surface of the transfer member. The parting agent is supplied to the surface of the transfer member by a parting agent applicator.

Although effective, the drawback of this approach is that the parting agent is consumable, and a structure to continuously supply the parting agent is required, which is generally expensive.

With reference to FIG. 13, a description is provided of contamination of the transfer member in known image forming apparatuses. In a case in which a user uses mostly recording media sheets of the same size, if the width of a secondary transfer roller 500 serving as a transfer member is not the same as the width of a recording medium P as illustrated in FIG. 13, end portions of the secondary transfer roller 500 in the axial direction thereof which are beyond the width of the recording medium are contaminated by toner. More specifically, the end portions of the secondary transfer roller 500 are contaminated because the toner once adhered undesirably onto an intermediate transfer belt 100 migrates to the end portions of the secondary transfer roller 500 where no recording medium passes, that is, the non-image formation area during the secondary transfer. Such toner accumulates at the end portions of the secondary transfer roller 500 over time.

In order to prevent contamination of the transfer member, various cleaning methods have been proposed.

For example, according to JP-2007-334011-A, a cleaning device is attached to a secondary transfer roller serving as the transfer device. However, although advantageous and generally effective for its intended purpose, there is a drawback to this configuration in that the dedicated cleaning device for the secondary transfer device increases the size and the cost of the image forming apparatus as a whole.

In JP-2008-090015-A, the image bearing member and the secondary transfer roller are separated from one another by a certain distance similar to a recording medium, thereby preventing contamination of the secondary transfer roller. In the meantime, an electric field opposite in charge to the electric field applied at transfer of toner to the recording medium is applied to the secondary transfer roller, thereby returning the toner once adhered to the secondary transfer roller to the image bearing member.

Although effective, the drawback of this approach is that separating the image bearing member from the secondary transfer roller and application of the opposite electric field to the transfer member degrade productivity.

In JP-2003-248361-A, in order to prevent contamination of the transfer member caused by toner in test patterns for adjustment of a toner density, the test patterns are supplied with opposite reversed electric charge by a charging device so that toner in the test patterns once transferred onto the second image bearing member are returned to the first image bearing member.

The drawback of this configuration is that, while the test patterns are supplied with the opposite electric charge, the actual printing operation cannot be performed, thereby decreasing productivity. Furthermore, a dedicated charging device is required, thereby increasing the cost.

BRIEF SUMMARY OF THE INVENTION

In view of the foregoing, in an aspect of this disclosure, there is provided an improved image forming apparatus including an image forming mechanism, an image bearing member, a transfer member, a transfer member mount, and an image detector. The image forming mechanism forms a first image and a second image on a surface of the image bearing member. The transfer member is disposed facing the image bearing member and contactable thereagainst to form a transfer nip at which the first image is transferred from the image bearing member to a recording medium. The transfer member mount, on which the transfer member is disposed, accommodates multiple different sizes of transfer member. The image detector detects the second image on the surface of the image bearing member.

According to another aspect, an image forming apparatus includes a main body, an image forming mechanism, an image bearing member, a plurality of interchangeable transfer members, an image detector, and a transfer member switching device. The image forming mechanism forms a first image and a second image on the surface of the image bearing member. Only one of the plurality of interchangeable transfer members is disposed facing the image bearing member at any given time and contactable thereagainst to form a transfer nip at which the first image is transferred from the image bearing member onto a recording medium. The plurality of transfer members includes a first transfer member to contact the image bearing member except an area at which the second image is formed and a second transfer member larger than the first transfer member to contact the image bearing member including over an area at which the second image is formed. The image detector detects the second image on a surface of the image bearing member. The transfer member switching device switches between the first transfer member and the second transfer member.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein:

FIG. 2 (*b*) is a schematic diagram illustrating the secondary transfer roller corresponding to an A3-portrait sheet and an A4-landscape sheet;

FIG. 2 (*c*) is a schematic diagram illustrating the secondary transfer roller corresponding to an A4-portrait sheet;

FIG. 6 (*b*) is a schematic diagram illustrating test patches formed on the intermediate transfer belt;

FIG. 9 (*b*) is a schematic diagram illustrating the test patches formed on the intermediate transfer belt;

DETAILED DESCRIPTION OF DISCLOSED EMBODIMENTS

Figure 1:
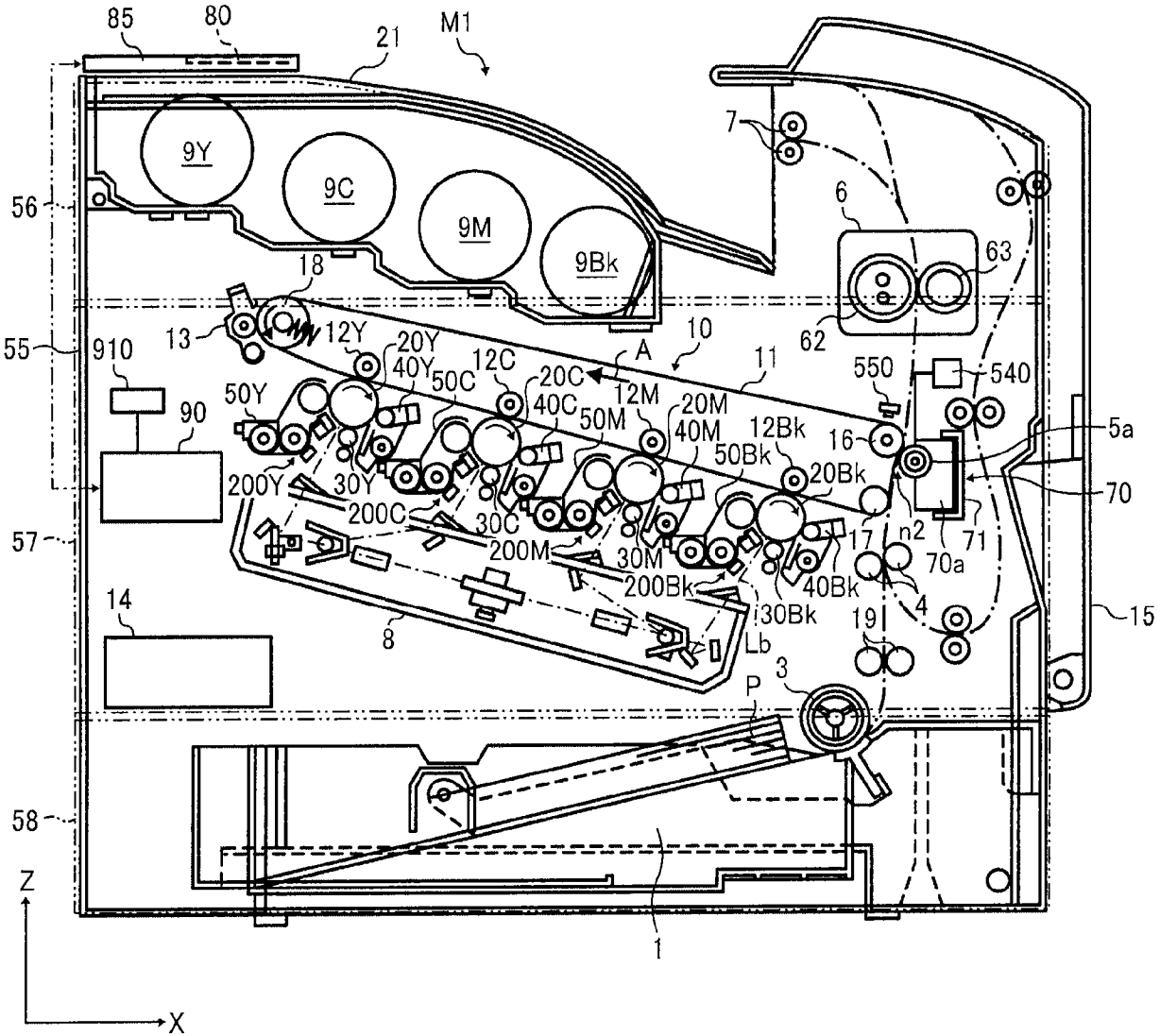
FIG. 1 is a schematic diagram illustrating a color printer as an example of the image forming apparatus according to an illustrative embodiment of the present invention.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, and initially with reference to FIG. 1, a description is provided of an image forming apparatus according to an aspect of this disclosure.

FIG. 1 is a schematic diagram illustrating a color printer as an example of the image forming apparatus. As illustrated in FIG. 1, an image forming apparatus M1 includes a main body 55, a transfer belt unit 10 equipped with an intermediate transfer belt 11 serving as an image bearing member, and four image forming stations 200Y, 200C, 200M, and 200Bk, each of which serves as an image forming mechanism. In the image forming stations 200Y through 200Bk, charging devices 30Y, 30C, 30M, and 30Bk, developing devices 50Y, 50C, 50M, and 50Bk, and cleaning devices 40Y, 40C, 40M, and 40Bk are respectively provided around the photosensitive drums 20Y, 20C, 20M, and 20Bk.

It is to be noted that the suffixes Y, C, M, and Bk denote colors yellow, cyan, magenta, and black, respectively. To simplify the description, these suffixes Y, M, C, and Bk indicating colors are omitted herein, unless otherwise specified.

The intermediate transfer belt 11 is formed into a loop and entrained around a plurality of rollers: a secondary transfer counter roller 16, a support roller 17, and a cleaning counter roller 18. The intermediate transfer belt 11 rotates in the direction indicated by arrow A.

Toner bottles 9Y, 9C, 9M, and 9Bk are disposed at an upper portion of the image forming apparatus M1 substantially above the image forming stations 200. Although not illustrated, the respective color of toner is supplied to the developing devices 50Y, 50C, 50M, and 50Bk as needed via toner transport paths.

As illustrated in FIG. 1, a setting changing device 85 (for example, an operation panel) serving as a mode selection device is disposed on an upper surface of an upper outer frame 56 of the image forming apparatus M1. The setting changing device 85 shows choices of operation instructions from which users select. The setting changing device 85 is connected to a controller 90 disposed inside the image forming apparatus main body 55. The operation instruction selected from the setting changing device 85 is converted to a signal and provided to the controller 90, thereby facilitating a later-described mode change with ease.

A stack of recording media sheets P or transfer sheets is stored in a sheet cassette 1 disposed at the bottom of the image forming apparatus M1. The sheet cassette 1 is equipped with a sheet feed roller 3 which picks up and feeds a top sheet of the stack of the recording media sheets to a pair of conveyance rollers 19 disposed in a sheet delivery path. Subsequently, the recording medium P is delivered to a pair of registration rollers 4.

When the leading edge of the recording medium reaches the pair of the registration rollers 4, a sheet detector detects the recording medium P and rotation of the registration rollers 4 stops temporarily. Based on a detection signal provided by the sheet detector, rotation of the registration rollers 4 resumes in appropriate timing so that the recording medium is sent to a place, a so-called transfer nip portion n2 (secondary transfer nip), where a secondary transfer roller 5 and the intermediate transfer belt 11 meet and press against each other.

The surfaces of the photosensitive drums 20Y, 20C, 20M, and 20Bk charged by the charging devices 30Y, 30C, 30M, and 30Bk are scanned by a laser beam projected from an optical writing unit 8, thereby forming electrostatic latent images of the respective colors on the photosensitive drums 20Y, 20C, 20M, and 20Bk. Each of the electrostatic latent images on the photosensitive drums 20Y, 20C, 20M, and 20Bk is developed with a respective color of toner by the developing devices 50Y, 50C, 50M, and 50Bk, respectively, thereby forming visible images, also know as toner images of yellow, cyan, magenta, and black on the surfaces of the photosensitive drums 20Y, 20C, 20M, and 20Bk, respectively.

Subsequently, a certain voltage is supplied to primary transfer rollers 12Y, 12C, 12M, and 12Bk. Accordingly, the toner images formed on the photosensitive drums 20Y, 20C, 20M, and 20Bk are primarily transferred onto the intermediate transfer belt 11 such that they are superimposed on one atop the other, thereby forming a composite toner image on the surface of the intermediate transfer belt 11. This process is known as primary transfer. Each of the primary transfer rollers 12Y, 12C, 12M, and 12Bk is supplied with a certain level of the constant-current controlled primary transfer bias for primary transfer. The primary transfer bias is controlled by the controller 90.

The toner images of different colors are transferred from the photosensitive drums 20Y, 20C, 20M, and 20Bk onto the intermediate transfer belt 11 at different timing such that the toner images are transferred at the same position on the intermediate transfer belt 11 while the intermediate transfer belt 11 rotates.

Figure 6:
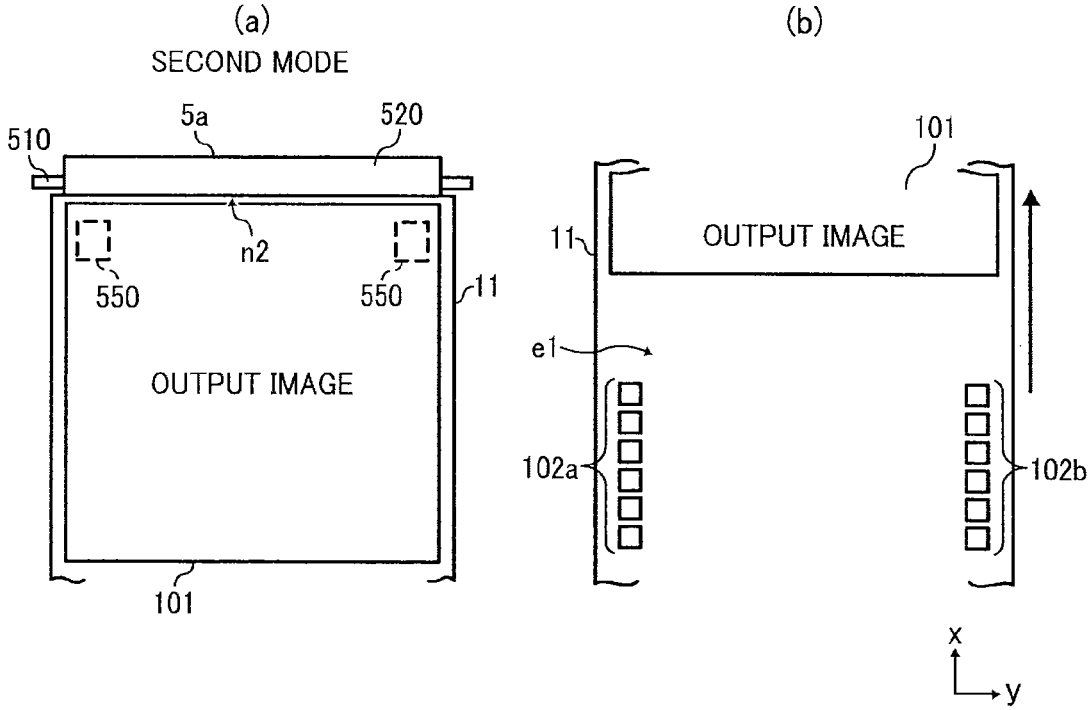
FIG. 6 (*a*) is a schematic diagram illustrating arrangement of the secondary transfer roller for the A3 plus sheet and an intermediate transfer belt employed in the image forming apparatus as viewed along arrow Z in FIG. 1.

As illustrated in FIG. 1, a secondary transfer roller 5*a* is supplied with a predetermined bias voltage (having a polarity opposite to the toner) by a bias power source 540 serving as an electric field generator. Subsequently, the composite toner image formed on the surface of the intermediate transfer belt 11 is delivered to the transfer nip portion n2 between the secondary transfer roller 5 and the intermediate transfer belt 11. The width of the transfer nip portion n2 extends in the main scanning direction of the secondary transfer roller 5*a* as illustrated in FIGS. 1 and 6. In the transfer nip portion n2, the composite toner image is secondarily transferred onto a recording medium due to the predetermined bias voltage in a process known as secondary transfer.

Subsequently, the recording medium on which the composite color toner image is secondarily transferred is delivered to a fixing device 6 equipped with a heating roller 62 and a pressing roller 63, and passes therethrough so that the composite color toner image is fixed onto the recording medium by heat and pressure in the fixing device 6. After the toner image is fixed, the recording medium is discharged onto a sheet output tray 21 by a pair of sheet discharge rollers 7. The sheet output tray 21 forms an upper surface of the image forming apparatus M1.

An image detector 550 is a reflection-type optical detector disposed facing end portions of the intermediate transfer belt 11 in the main scanning direction. The image detector 550 detects the density of test patterns (second image) formed on the intermediate transfer belt 11.

According to the illustrative embodiment, the recording medium is delivered from the sheet cassette 1 at the bottom of the main body 55 to the transfer nip n2 above the sheet cassette 1 in a vertical direction in the image forming apparatus M1 according to an illustrative embodiment of the present invention.

Residual toner remaining on the photosensitive drums 20Y, 20C, 20M, and 20Bk after primary transfer is cleaned by the cleaning devices 40Y, 40C, 40M, and 40Bk, respectively. After cleaning, residual charge on the photosensitive drums 20Y, 20C, 20M, and 20Bk is removed, and in the meantime the photosensitive drums 20Y, 20C, 20M, and 20Bk are charged by the charging devices 30Y, 30C, 30M, and 30Bk in preparation for the subsequent imaging cycle.

Residual toner remaining on the intermediate transfer belt 11 is cleaned by a belt cleaning device 13 in preparation for the subsequent imaging cycle.

For double sided printing, the recording medium is delivered to a duplexing unit 15 in which the recording medium is turned over, and then delivered to the pair of registration rollers 4. The duplexing unit 15 includes at least a transport path. As illustrated in FIG. 1, the duplexing unit 15 is openably provided to the side surface of the image forming apparatus main body 55.

The duplexing unit 15 may include transport rollers that transport the recording medium by interposing the recording medium therebetween, a manual feed tray with a feed roller to feed the recording medium to the transfer nip portion n2, and a driving device such as a motor for driving the transport rollers and the feed roller.

As illustrated in FIG. 1, the main body 55 includes a waste toner bin 14 that collects waste toner after the transfer process. It is to be noted that the secondary transfer roller 5*a* is disposed at a secondary transfer position.

Figure 2:
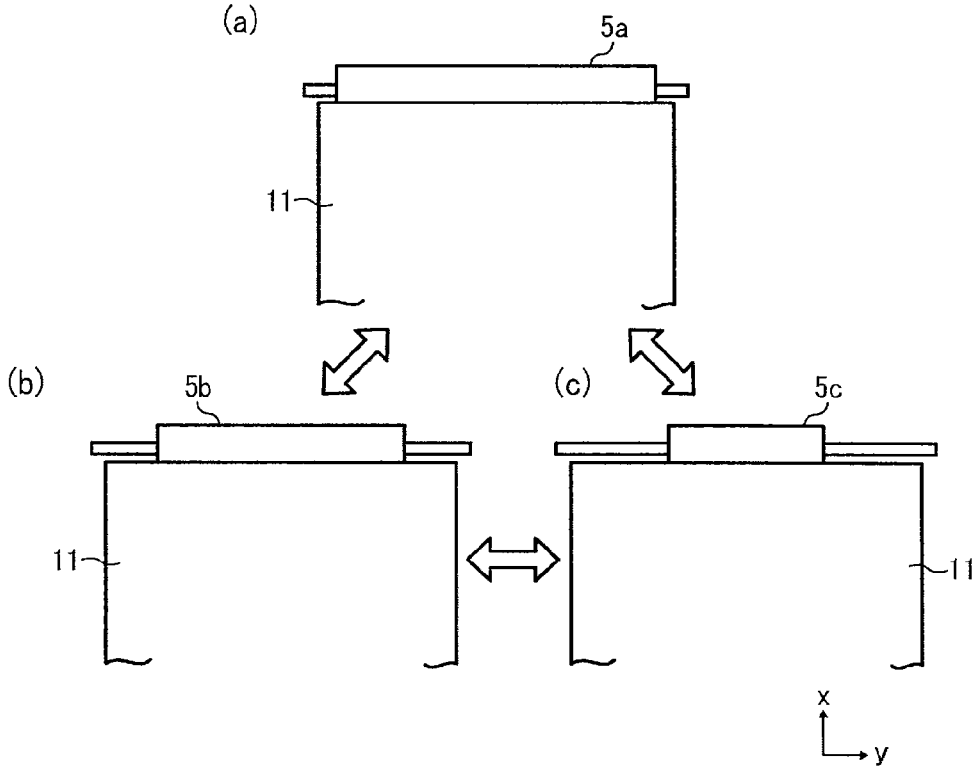
FIG. 2 (*a*) is a schematic diagram illustrating a secondary transfer roller employed in the image forming apparatus of FIG. 1, corresponding to an A3 plus sheet that measures approximately 329 mm×483 mm.

With reference to FIGS. 1 and 2 (*a*) through (*c*), a description is provided of a plurality of secondary transfer rollers 5*a* through 5*c* selectively used in the image forming apparatus M1 and usable recording media sheets associated with the secondary transfer rollers 5*a* through 5*c*.

As illustrated in FIG. 1, the image forming apparatus M1 includes a secondary transfer unit 70. The secondary transfer unit 70 employs one of the secondary transfer rollers 5*a*, 5*b*, and 5*c* and a roller support assembly 70*a* that supports a shaft of the respective secondary transfer roller 5. It is to be noted that the secondary transfer rollers 5*a*, 5*b*, and 5*c* may be referred to collectively as "secondary transfer roller 5" when discrimination therebetween is not required. The main body 55 of the image forming apparatus M1 includes a roller guide 71 serving also as a roller mount.

According to the illustrative embodiment shown in FIG. 1, the secondary transfer unit 70 employing the secondary transfer roller 5*a* and the roller support assembly 70*a* for supporting the roller shaft of the secondary transfer roller 5 are mountable on the roller guide 71. Similarly, the secondary transfer unit 70 employing the secondary transfer roller 5*b* or 5*c* and the roller support assembly 70*a* can be mounted on the roller guide 71.

FIGS. 2 (*a*) through (*c*) show the secondary transfer rollers 5*a* through 5*c* having different widths and the intermediate transfer belt 11 as viewed along arrow Z in FIG. 1. FIG. 2 (*a*) is a schematic diagram illustrating the secondary transfer roller 5*a* corresponding to an A3 plus size sheet. FIG. 2 (*b*) is a schematic diagram illustrating the secondary transfer roller 5*b* corresponding to an A3-portrait sheet and an A4-landscape sheet. FIG. 2 (*c*) is a schematic diagram illustrating the secondary transfer roller 5*c* corresponding to an A4-portrait sheet. It is to be noted that an "A3 plus" sheet refers to a sheet which measures approximately 329 mm×483 mm.

The secondary transfer roller 5*a* illustrated in FIG. 2 (*a*) can accommodate an A3 plus recording medium, and has the greatest width in the main scanning direction among all the secondary rollers 5*b* and 5*c* employed in the secondary transfer unit 70 of the image forming apparatus M1. The secondary transfer roller 5*b* has a width that allows the A3-portrait and A4-landscape sheet to pass. The secondary transfer roller 5*c* has a width that allows the A4-portrait sheet to pass.

Although not illustrated, secondary transfer rollers that accommodate B4 and B5 sheets can be also mounted in the secondary transfer unit 70. With this configuration, the secondary transfer rollers 5*a* through 5*c* having different widths in the main scanning direction can be replaced and mounted in the secondary transfer unit 70. Moreover, different secondary transfer units 70 employing different sizes of the secondary transfer rollers 5 are mountable on the roller guide 71. Accordingly, the secondary transfer unit 70 corresponding to the width of the most frequently used recording media sheets can be mounted in the image forming apparatus M1.

With reference to FIGS. 6 (*a*) and 6 (*b*), a description is provided of formation of test patches 102*a* and 102*b* for adjustment of image density. Generally, the test patches 102*a* and 102*b* are formed during image forming control (also known as a process control) in the image forming apparatus M1.

FIG. 6 (*a*) is a schematic diagram illustrating relative positions of the secondary transfer roller 5*a* and the intermediate transfer belt 11 as viewed along arrow Z in FIG. 1. FIG. 6 (*b*) is a schematic diagram illustrating the test patches 102*a* and 102*b* formed on the intermediate transfer belt 11 as viewed along arrow Z in FIG. 1.

As illustrated in FIG. 6 (*a*), the secondary transfer roller 5*a* contacts the intermediate transfer belt 11 including both ends thereof at which the test patches 102*a* and 102*b* are formed, thereby forming the transfer nip portion n2 (second transfer nip). In a case in which the secondary transfer roller 5*a* having the longest possible width for the transfer unit 70 is mounted, that is, the secondary transfer roller 5*a* that can accommodate an A3 plus recording medium is mounted, the test patches 102*a* and 102*b* are formed at specific times such as between successive output images 101 (between a previous and a subsequent images). In other words, as illustrated in FIG. 6 (*b*), the test patches 102*a* and 102*b* are formed at an area e1 between successive output images in the sub-scanning direction (in the vertical direction in FIG. 6 (*b*)). The output image 101 is also referred to as a first image; whereas, the test patches 102*a* and 102*b* are referred to as a second image.

A description is provided of when the test patches 102*a* and 102*b* are formed. In a case in which the secondary transfer roller 5*a* is employed, as illustrated in FIG. 6 (*b*), the test patches 102*a* and 102*b* are formed after the trailing edge of the output image 101 to be output on a recording medium.

That is, the image forming stations 200 form the test patches 102*a* and 102*b* at a different time from formation of the output image 101 (Second mode).

Using the secondary transfer roller 5*a* (corresponding to an A3 plus sheet) allows formation of a large image having a wide width including the test patch formation area on a recording medium. By forming the test patches 102*a* and 102*b* at a different time from formation of the output image 101, contamination of the end portions of the secondary transfer roller 5*a* and the output image is prevented.

Figure 7:
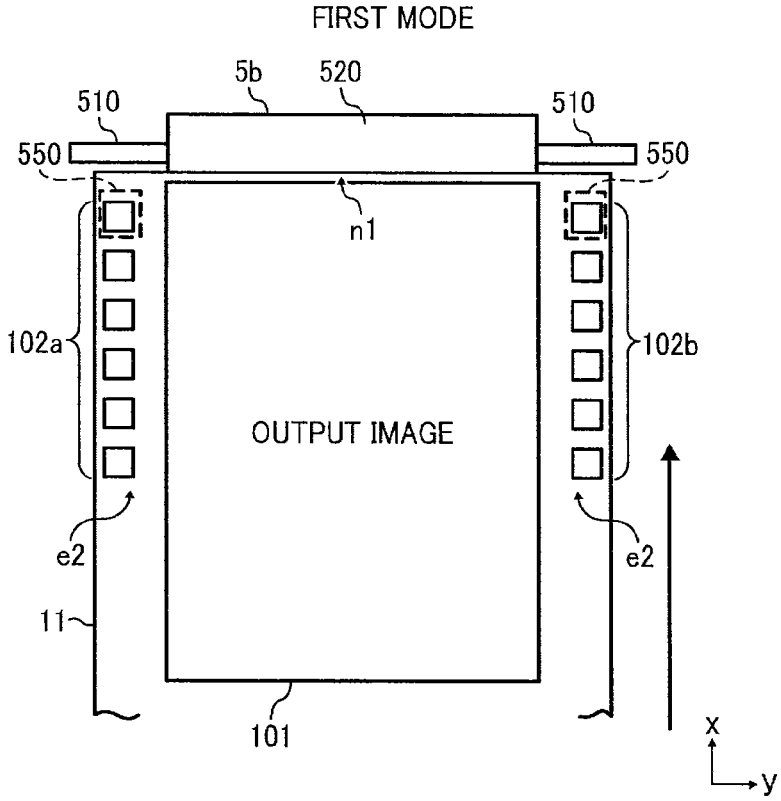
FIG. 7 is a schematic diagram illustrating relative positions of the transfer member corresponding to an A3-portrait recording medium and the intermediate transfer belt employed in the image forming apparatus of FIG. 1.

With reference to FIG. 7, a description is provided of the secondary transfer rollers 5*b* (5*c*). FIG. 7 illustrates relative positions of the secondary transfer roller 5*b* (5*c*) and the intermediate transfer belt 11 as viewed along arrow Z in FIG. 1. As illustrated in FIG. 7, the secondary transfer roller 5*a* (or 5*c*) contacts the intermediate transfer belt 11 except the area substantially at both ends thereof at which the test patches 102*a* and 102*b* are formed, thereby forming a transfer nip portion n1 (first transfer nip).

In a case in which the secondary transfer roller 5*b* (5*c*) is employed, the test patches 102*a* and 102*b* are formed at the left and the right sides of the output image 101 to be transferred onto the recording medium (a first mode). In other words, the image forming stations 200 form at least a portion of the test patches 102*a* and 102*b* on the intermediate transfer belt 11 at the same time as formation of the output image 101 on the intermediate transfer belt 11.

Furthermore, using the secondary transfer roller 5*b* (or 5*c*) prevents reliably contamination of the secondary transfer roller 5*b* (or 5*c*). According to the present illustrative embodiment, at least a portion of the test patches 102*a* and 102*b* is formed on the intermediate transfer belt 11 at the same time as formation of the output image on the intermediate transfer belt 11 as compared with forming all of the test patches 102*a* and 102*b* on the intermediate transfer belt 11 at a time different from formation of the output image. With this configuration, degradation of productivity is prevented.

It is to be noted that in the example shown in FIG. 7 all of the test patches 102*a* and 102*b* are formed at the same time as the output image 101. Alternatively, a portion of the test patches 102*a* and 102*b* is formed on the intermediate transfer belt 11 at the same time as the output image 101, and the remaining test patches 102*a* and 102*b* are formed at a different time from the output image 101.

According to an illustrative embodiment, timing at which the test patches 102*a* and 102*b* are formed is can be changed by the controller 90. The controller 90 changes the timing at which the test patches are formed such that the difference in the length of secondary transfer rollers 5 is obtained, that is, the length of the secondary transfer roller in the main scanning direction is obtained (by a laser displacement detector 51 shown in FIG. 3) in advance. Subsequently, according to the length of the secondary transfer roller 5, the timing at which the test patches 102*a* and 102*b* are formed is changed. As will be described later in detail, the controller 90 may change the test patch formation timing in accordance with roller identification numbers R1, R2, and R3 shown in FIG. 8.

Figure 9:
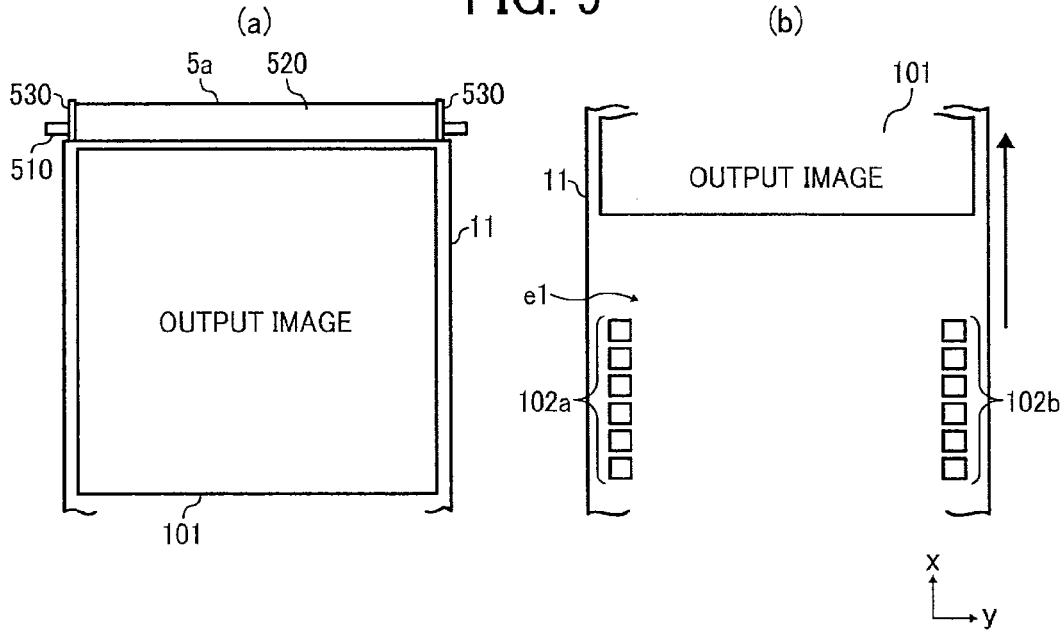
FIG. 9 (*a*) is a schematic diagram illustrating relative positions of the secondary transfer roller with a track roller corresponding to an A3 plus sheet and the intermediate transfer belt as viewed along arrow Z in FIG. 1.

Still alternatively, as illustrated in FIG. 9, a track roller 530 may separate the secondary transfer roller 5*a* from the intermediate transfer belt 11, thereby preventing the secondary transfer roller 5*a* from coming into contact with the test patches 102*a* and 102*b*. When the process control such as adjustment of image density is performed while using the secondary transfer roller 5*a*, the above described control needs to be performed. During adjustment of image density between successive recording media sheets, that is, at e1 shown in FIG. 6, printing operation is not carried out, thus degrading productivity.

In view of the above, for users who use mostly a recording medium having the size equal to or less than A3, the secondary transfer roller 5*b* corresponding to the width of the recording medium as illustrated in FIG. 7 is selected and installed. As described above, the width of the secondary transfer roller 5*b* is less than that of the secondary transfer roller 5*a*.

Accordingly, the secondary transfer roller 5*b* having the width similar to or equal to the width of the toner image on the intermediate transfer belt 11 in the main scanning direction indicated by arrow Y is used selectively. With this configuration, a margin or a free space is formed at both ends of the secondary transfer roller 5*b* in the main scanning direction (Y direction) at which no transfer process is performed, thereby preventing the secondary transfer roller 5*b* from contacting an edge portion e2 of the intermediate transfer belt 11 and getting contaminated by toner.

Furthermore, since the test patches 102*a* and 102*b* are formed at the edge portions e2 of the intermediate transfer belt 11 in the main scanning direction (Y direction), the image density is adjusted while image forming operation is performed.

According to the present illustrative embodiment, the secondary transfer roller 5*b* having the width corresponding to the width of the recording medium is selected. This eliminates need for separating the secondary transfer roller 5*b* from the intermediate transfer belt 11 upon adjustment of image density. Thus, degradation of productivity is prevented.

Although it is not necessary to separate the secondary transfer roller 5*b* from the intermediate transfer belt 11 in this configuration as described above, securing a space between the secondary transfer roller 5*b* and the intermediate transfer belt 11 can prevent more reliably the contamination of the secondary transfer roller 5*b* with residual toner remaining on the intermediate transfer belt 11. More specifically, the secondary transfer roller 5*b* is prevented from contacting directly the intermediate transfer belt at the place e1 between successive recording media sheets.

Referring back to FIG. 1, as indicated by double-dot-dash lines, the front side of the main body 55 of the image forming apparatus is surrounded by the upper outer frame 56 fixed to the upper portion of the main body 55, a center cover piece 57 below the upper outer frame 56, and a sheet cassette outer door 58. Below the center cover piece 57, the sheet cassette 1 which can be pulled out from the main body 55 is covered by the sheet cassette outer door 58.

The center cover piece 57 is openably supported by the main body 55 such that one of the vertically extending side edges of the center cover piece 57 is pivotally supported by a shaft about which the center cover piece 57 rotates and the other side can be opened to the front. The center cover piece 57 can be opened upon maintenance of the inside of the main body 55 of the image forming apparatus.

Figure 10:
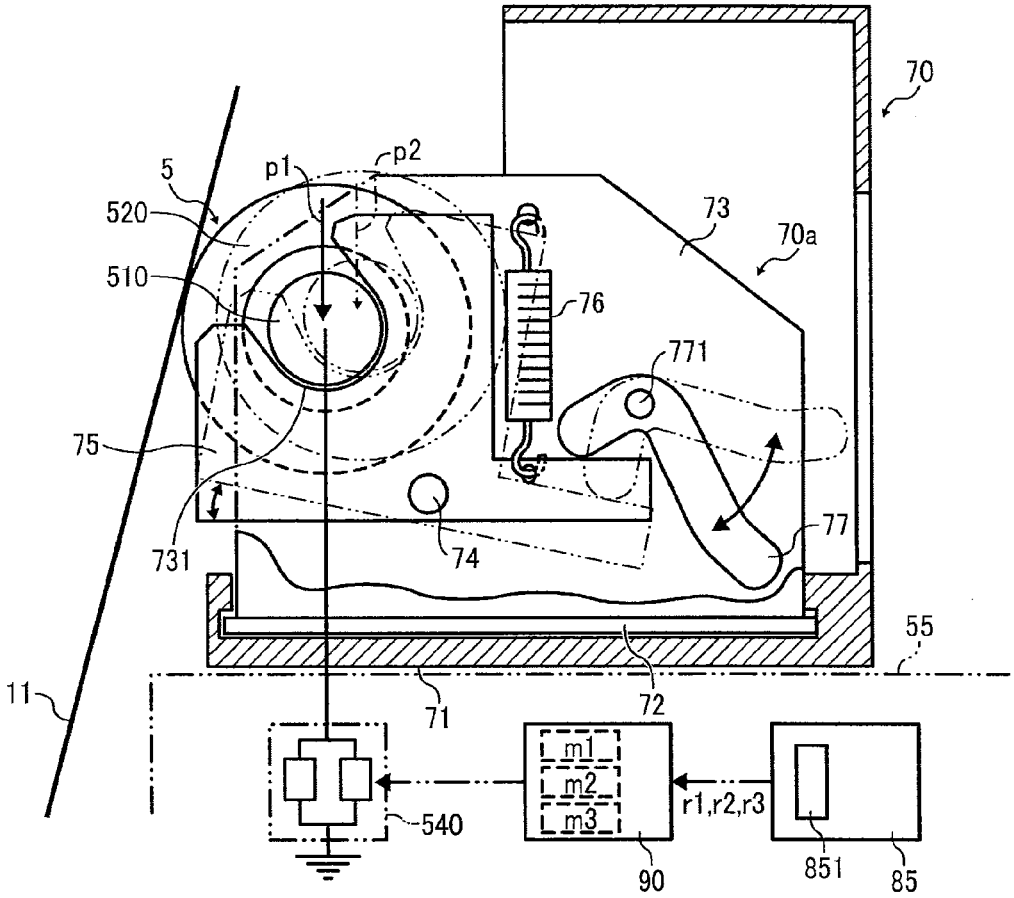
FIG. 10 is an enlarged side view schematically illustrating a secondary transfer unit employed in the image forming apparatus of FIG. 1.

With reference to FIG. 10, a description is provided of the secondary transfer unit 70 employed in the image forming apparatus M1 according to an illustrative embodiment of the present invention. FIG. 10 is an enlarged side view schematically illustrating the secondary transfer unit 70.

The image forming apparatus main body 55 supports the roller guide 71. As illustrated in FIG. 10, the secondary transfer unit 70 includes the secondary transfer roller 5 and the roller support assembly 70*a* for supporting the shaft of the secondary transfer roller 5. The roller support assembly 70*a* includes a sliding member 72, a roller support main body 73, a movable frame 75, a pressing spring 76, a switching lever 77, and so forth. The sliding member 72 is slidably guided by the roller guide 71. The roller support main body 73 is fixed to the sliding member 72. The movable frame 75 is pivotally and swingably supported by the roller support main body 73 via a support shaft 74 while the secondary transfer roller 5 is rotatably held on a support portion 731. The pressing spring 76 biases the secondary transfer roller 5 on the movable frame 75 so that the secondary transfer roller 5 is pressed against the intermediate transfer belt 11. The switching lever 77 changes the position of the secondary transfer roller 5 on the movable frame 75 between a transfer position p1 and a retracted position p2 relative to the roller support main body 73. When the secondary transfer roller 5 is at the transfer position p1, the secondary transfer roller 5 pressingly contacts the intermediate transfer belt 11.

The switching lever 77 is a bent lever, a portion of which is bent at a certain angle. The switching lever 77 includes a support shaft 771 substantially at the center thereof. The support shaft 771 is held by the roller support main body 73. The position of the switching lever 77 is changed manually.

More specifically, when the switching lever 77 is at the transfer position p1, the secondary transfer roller 5 is pressed against the intermediate transfer belt 11. When the switching lever 77 is at the retracted position p2, the secondary transfer roller 5 is separated from the intermediate transfer belt 11, thereby allowing the roller support main body 73 fixed to the sliding member 72 to be pulled toward the front of the drawing with ease relative to the roller guide 71.

The secondary transfer roller 5 includes a metal cored bar 510 covered with an elastic layer 520. The elastic layer 520 is made of semiconductive (in a range of from $10^5\Omega\cdot$cm to $10^9\Omega\cdot$cm) urethane foam rubber. An outer diameter of the secondary transfer roller 5 is approximately 16 mm, for example. As illustrated in FIG. 9, when the secondary transfer roller 5*a* (corresponding to an A3 plus sheet) is employed, the end portions of the metal cored bar 510 are supported by the track rollers 530 which come into contact with the intermediate transfer belt 11, instead of the secondary transfer roller 5*a*.

With this configuration, a space of, for example, approximately 0.1 mm is formed between the secondary transfer roller 5*a* and the intermediate transfer belt 11. Furthermore, the secondary transfer roller 5 is rotated by a driving device at the same peripheral speed as that of the intermediate transfer belt 11.

As illustrated in FIG. 1, the recording medium is introduced to the space at the secondary transfer position by the pair of conveyance rollers 19 and the pair of registration rollers 4 at the same speed as the moving speed of the intermediate transfer belt 11. As illustrated in FIG. 10, the constant-current controlled secondary transfer bias for secondary transfer is supplied to the metal cored bar 510 of the secondary transfer roller 5 by the bias power source 540 serving as a secondary transfer bias application device. The bias power source 540 is subjected to positive-negative switching control. The bias power source 540 is controlled by the controller 90.

More specifically, as the leading edge of the recording medium enters the space at the secondary transfer position, the bias power source 540 supplies a predetermined bias voltage (having an opposite polarity to the toner) to the secondary transfer roller 5, thereby enhancing transfer. By contrast, when the secondary transfer roller 5 faces the area e1 between successive recording media sheets, a bias voltage having the same polarity as toner is supplied to the secondary transfer roller 5, thereby hindering transfer.

As described above, securing the space between the secondary transfer roller 5 and the intermediate transfer belt 11 can prevent the secondary transfer roller 5 from directly contacting the intermediate transfer belt 11 at the area e1 between successive recording media sheets (in the sub-scanning direction X) arriving at the secondary transfer position, hence preventing the secondary transfer roller 5 from getting contaminated by the residual toner remaining in the area e1 on the intermediate transfer belt 11 or by the test patterns 102*a* and 102*b*. Moreover, because the transfer roller bias power source 540 (subjected to positive-negative switching control) supplies the bias voltage having the same polarity as toner to the secondary transfer roller 5 when the secondary transfer roller 5 faces the area e1, the residual toner adhering to the area e1 and the test patterns 102*a* and 102*b* are returned electrostatically to the intermediate transfer belt 11 side so that the secondary transfer roller 5 does not get contaminated.

Figure 8:
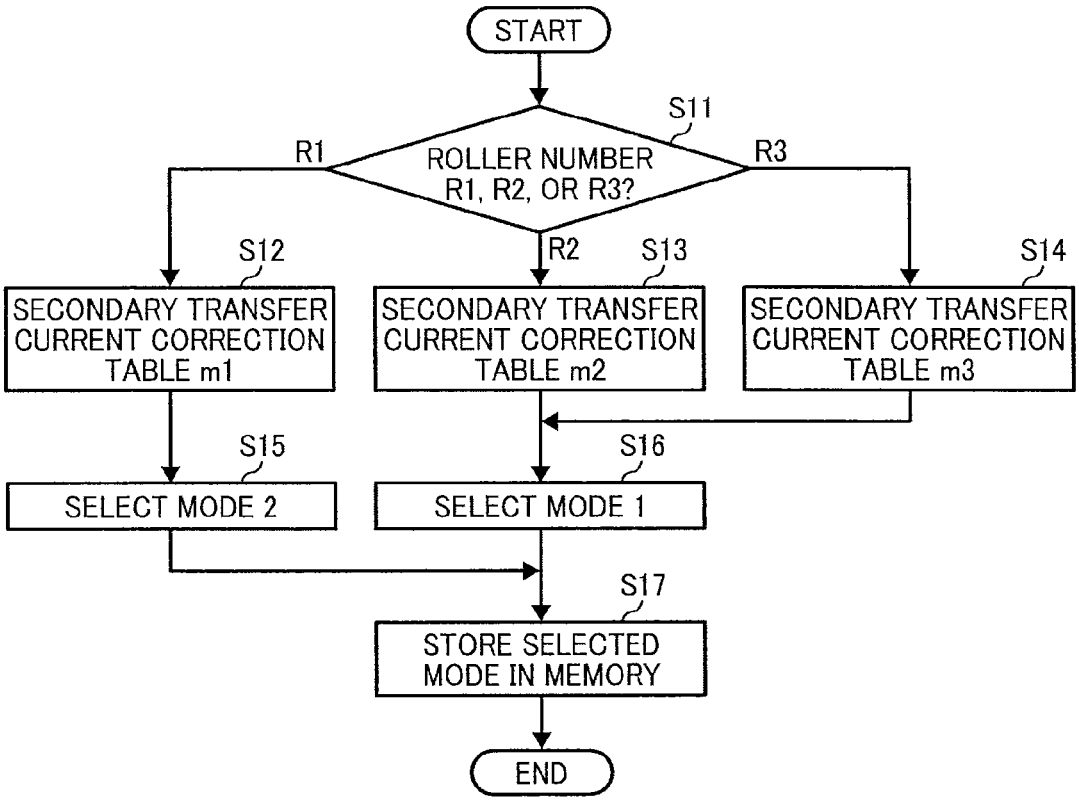
FIG. 8 is a flowchart showing steps of adjustment of image density corresponding to the secondary transfer roller employed in the image forming apparatus.

Next, with reference to FIG. 8, a description is provided of steps of adjustment of image density corresponding to the secondary transfer roller 5 manually replaced prior to printing operation in the image forming apparatus M1. FIG. 8 is a flowchart showing steps of adjustment of image density corresponding to the replaced secondary transfer roller 5 employed in the image forming apparatus M1.

As described above, the image forming apparatus M1 includes the setting changing device (operation panel) 85 and the controller 90 to control the image forming stations 200. As shown in FIG. 7, by using the setting changing device 85 of the image forming apparatus M1, one of the first mode in which at least a portion of the test patches 102*a* and 102*b* is formed on the intermediate transfer belt 11 at the same time as formation of the output image 101 and the second mode in which the test patches 102*a* and 102*b* are formed on the intermediate transfer belt 11 at a different time from formation of the output image 101 is selected. The controller 90 controls the image forming stations 200 such that the test patches 102*a* and 102*b* are formed on the intermediate transfer belt 11 based on the selected mode by the setting changing device 85.

In a case in which the secondary transfer roller 5 is replaced manually, technicians change the setting of the image forming apparatus after replacement of the roller. That is, the technicians change the setting of the apparatus by entering a roller identification number for the respective secondary transfer roller 5 using the setting changing device 85. Each roller is provided with a roller identification number which corresponds to the width of the roller.

More specifically, as illustrated in FIG. 8, for example, the technicians enter one of the roller identification numbers R1, R2, and R3 using an input device 851 of the setting changing device 85 in accordance with the secondary transfer rollers 5*a* shown in FIG. 2 (*a*), 5*b* shown in FIG. 2 (*b*), and 2*c* shown in FIG. 2 (*c*). In accordance with the roller identification number entered by the technicians, the control shown in FIG. 8 is performed.

At S11, the controller 90 identifies the entered roller identification number (R1, R2, or R3) at S11 in FIG. 8. In accordance with the roller identification number, one of secondary transfer current correction tables m1 through m3 is selected (See FIG. 8). A correction coefficient an is read from the selected table at S12, S13, or S14.

Subsequently, a base transfer bias bV is multiplied by the correction coefficient an to obtain the secondary transfer bias bV (S12, S13, or S14). Next, if the processing proceeds to S15, the controller 90 selects the second mode. By contrast, if the processing proceeds to S16, the controller 90 selects the first mode.

As illustrated in FIG. 8, the controller 90 stores the value corresponding to the mode provided by the setting changing device 85 in a memory 910 at S17. For example, if the setting changing device 85 selects the second mode at S15, the controller 90 stores a value "0" in the memory 910. If the setting changing device 85 selects the first mode at S16, the controller 90 stores a value "1" in the memory 910.

After the controller 90 stores the value in the memory 910, the setting modification mode is finished.

After the setting modification mode is finished, the controller 90 controls the image forming stations 200 such that the output image 101 and the test patches 102*a* and 102*b* are formed on the intermediate transfer belt 11 based on the mode selected by the setting changing device 85.

In a case in which the value "0" is stored in the memory 910, the controller 90 controls the image forming stations 200 such that the toner patches 102*a* and 102*b* are formed on the intermediate transfer belt 11 at a different time from formation of the output image 101. With this configuration, the output image having a wide width including the patch formation area can be formed on the intermediate transfer belt 11 and transferred onto a recording medium. Moreover, contamination of the end portions of the secondary transfer roller 5 and the output image 101 by the test patches 102*a* and 102*b* is prevented.

In a case in which the value "1" is stored in the memory 910, the controller 90 controls the image forming stations 200 such that at least a portion of the toner patches 102*a* and 102*b* is formed on the intermediate transfer belt 11 at the same time as formation of the output image 101 on the intermediate transfer belt 11. With this configuration, the secondary transfer roller 5 does not have to be separated from the intermediate transfer belt 11, thereby maintaining productivity.

As described above, the image forming apparatus M1 includes the setting changing device 85 so that the technicians can choose easily a time at which the image forming stations 200 form the test patches 102*a* and 102*b* in accordance with the type of the secondary transfer roller 5 (transfer member) mounted on the roller guide 71. With this configuration, after replacing the secondary transfer roller with the one that is suitable for the recording medium, the patch formation timing can be changed easily to the timing suitable for the secondary transfer roller 5.

In a case in which the power of the image forming apparatus M1 is turned off and then turned back on again, by storing the value corresponding to the type of mode in the memory 910, image density can be adjusted in accordance with the stored mode in the memory 910 without changing the setting again.

Depending on the roller identification number, the controller 90 refers to a different correction table of the secondary transfer current and changes the correction coefficient of the secondary transfer bias accordingly. With this configuration, an optimum secondary transfer bias for the secondary transfer roller is supplied at transfer.

In the case of the correction table m2 (when using the secondary transfer roller 5*b*), the bias power source 540 outputs the secondary transfer current having a smaller absolute value than the correction table m1 (when using the secondary transfer roller 5*a*).

In the case of the correction table m3 (when using the secondary transfer roller 5*c*), the bias power source 540 outputs the secondary transfer current having a smaller absolute value than the correction table m2 (when using the secondary transfer roller 5*b*). Accordingly, an optimum secondary transfer current can be supplied to the secondary transfer roller 5 by changing the secondary transfer current by the setting changing device 85.

In the case of S15, the bias power source 540 supplies the secondary transfer bias bV having the same polarity as toner as the optimum bias.

In the case of S16, the bias power source 540 supplies the optimum secondary transfer bias bV obtained at S13 and S14 to the secondary transfer roller 5.

Figure 3:
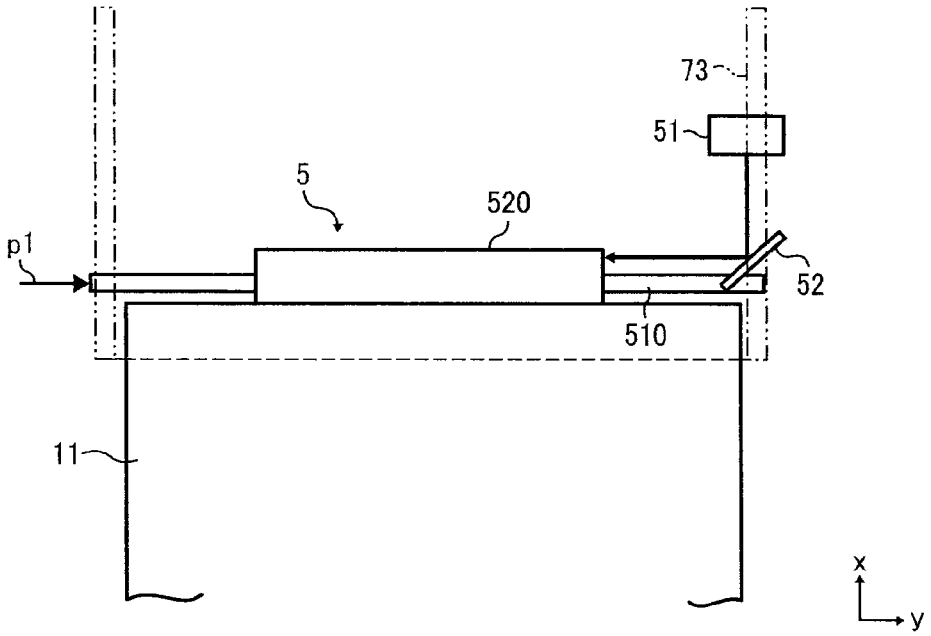
FIG. 3 is a schematic diagram illustrating positional relations of the secondary transfer roller, a laser displacement detector for detection of the width of the secondary transfer roller, and a mirror.

With reference to FIG. 3, a description is provided of detection of the size of the secondary transfer rollers 5 selectively employed in the image forming apparatus M1.

FIG. 3 is a schematic diagram illustrating positional relations of the secondary transfer roller 5, the laser displacement detector 51 for detection of the width of the secondary transfer roller 5, and a mirror 52. In the example shown in FIG. 3, the laser displacement detector 51 is used to detect the position of end portions of the secondary transfer roller 5 to detect the length of the secondary transfer roller 5.

The secondary transfer roller 5 is supported by the roller support main body 73 at the image forming apparatus main body side. In the example shown in FIG. 3, the length of the secondary transfer roller 5 is detected when the secondary transfer roller 5 is disposed at the transfer position p1 (shown in FIG. 10).

When using laser light, ideally, the laser displacement detector 51 is disposed in the axial direction which is the main scanning direction of the secondary transfer roller 5. However, the installation space may be limited.

In view of the above, according to the present illustrative embodiment, the laser displacement detector 51 is disposed at a position perpendicular to the axial direction shown in FIG. 3 and supported on the roller support main body 73. The mirror 52 supported on the roller support main body 73 deflects laser light at a right angle (90 degrees) to detect the position of the end portions of the secondary transfer roller 5.

The position of the end portions of the secondary transfer roller 5 is associated with the length of the secondary transfer roller 5 in advance. Accordingly, the length of the secondary transfer roller 5 is detected based on the position of the end portions of the secondary transfer roller 5.

The detector is not limited to the laser displacement detector 51. For a less expensive configuration, for example, a through-beam type sensor having the size within which the secondary transfer roller 5 fits in the axial direction may be used. With this configuration, the length of the roller can be detected by determining whether or not the edge of the roller exceeds the sensor.

Figure 4:
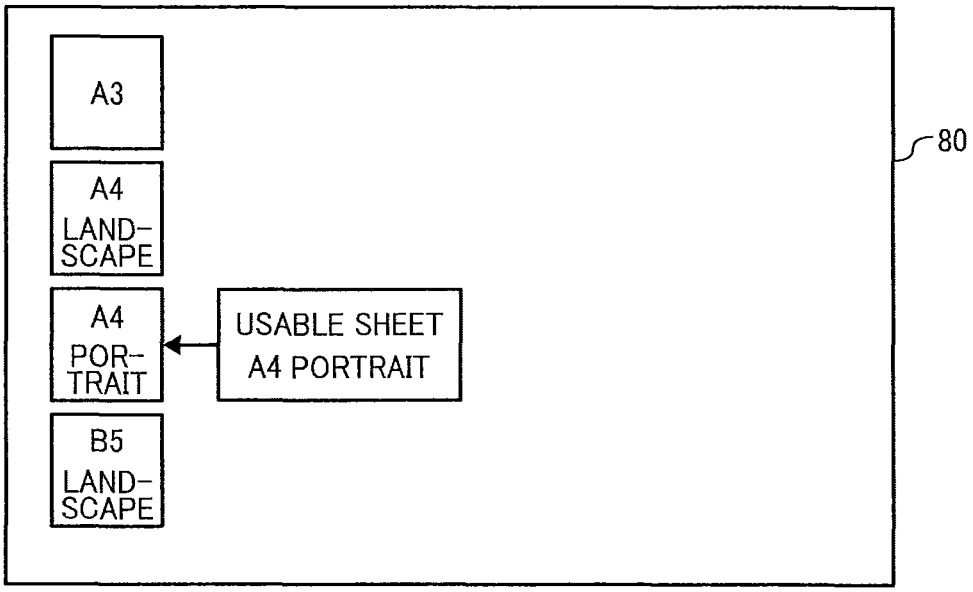
FIG. 4 is a plan view illustrating an example of a monitor that shows a usable recording medium.

Next, with reference to FIG. 4, a description is provided of an example of notification of a recording medium selectively used in the image forming apparatus M1 to a user. FIG. 4 is a plan view illustrating a monitor 80 that shows usable recording media sheets.

The setting changing device 85 includes the monitor 80 on the upper outer frame 56 (shown in FIG. 1) of the image forming apparatus M1. According to present illustrative embodiment, based on the detected length of the secondary transfer roller 5 (serving as a transfer member) in the main scanning direction as described above, the size of the recording medium that can be used is determined. Based on the result, the monitor 80 indicates (shows) usable recording media sheets as illustrated in FIG. 4. With this configuration, the user is notified of a usable recording medium, thereby preventing the user from choosing a recording medium of a wrong size.

Alternatively, based on the result of detection of the secondary transfer roller 5, the monitor 80 may only show the usable recording medium.

Figure 5:
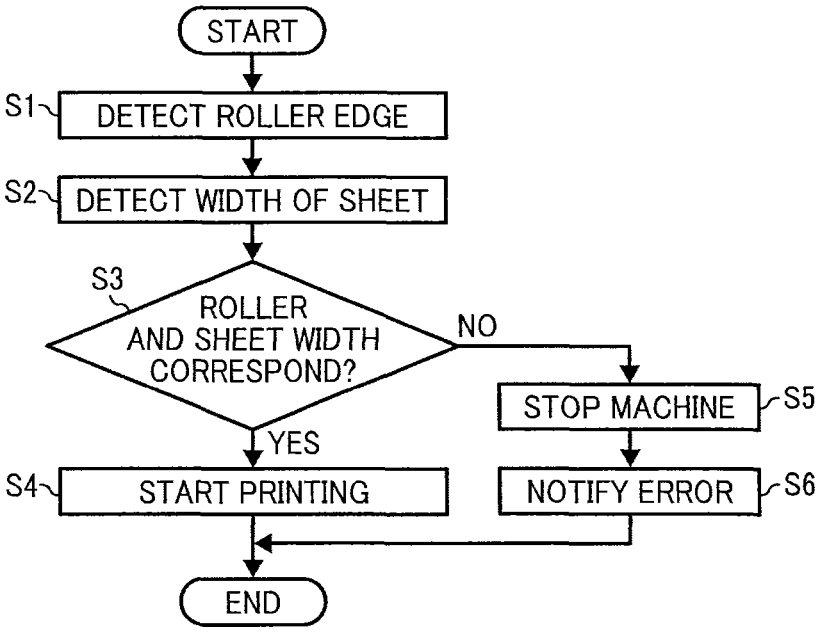
FIG. 5 is a flowchart showing steps of verification of the secondary transfer roller corresponding to a recording medium.

Next, with reference to FIG. 1, a description is provided of a procedure of verification of the secondary transfer roller 5 corresponding to the recording medium in the image forming apparatus M1 before printing operation starts. FIG. 5 is a flowchart showing steps of verification of the secondary transfer roller 5 corresponding to the recording medium.

As shown in FIG. 5, at a stand-by mode awaiting the print instruction, the length of the secondary transfer roller 5 mounted in the roller support main body 73 of the secondary transfer unit 70 is detected at S1, and subsequently, the width of the recording medium stored in the sheet cassette 1 is detected at S2. After the width of the recording medium is detected, whether or not the secondary transfer roller 5 can accommodate the width of the recording medium is determined at S3.

In other words, it is determined whether the width of the secondary transfer roller 5 corresponds to the width of the recording medium so that a margin or a non-transfer portion at which no transfer process is performed is not formed at both ends of the secondary transfer roller 5 in the axial direction thereof and thus the margin does not get contaminated by toner.

If the width of the secondary transfer roller 5 corresponds to the width of the recording medium (Yes at S3), the recording medium is fed and printing is initiated at S4. By contrast, if the width of the secondary transfer roller 5 does not correspond to the width of the recording medium (No at S3), the printing operation is stopped at S5.

More specifically, the printing operation is stopped at S5, and the user is notified of an error at S6. For example, the user is notified such that a message indicating the error is shown on the monitor 80.

With this configuration, only the proper recording medium, that is, the recording medium corresponding to the width of the secondary transfer roller 5 is fed so that the margin on the secondary transfer roller 5 where no transfer process is performed does not get contaminated, hence preventing a transfer failure and the rear surface of the recording medium from getting contaminated. Ultimately, unnecessary paper waste is prevented.

As described above, in a case in which the width of the secondary transfer roller 5 does not match the width of the recording medium in the main scanning direction in the image forming apparatus M1, the printing operation of the image forming apparatus M1 is stopped, thus preventing reliably a transfer failure and unnecessary paper waste. In other words, only the recording medium having the width corresponding to the size of the secondary transfer roller 5 is fed. Even when a user chooses a recording medium having a wrong size, the process stops before transfer so that contamination of the transfer roller and a transfer failure at the end portions of the recording medium are prevented. Unnecessary paper waste is also prevented.

Figure 12:
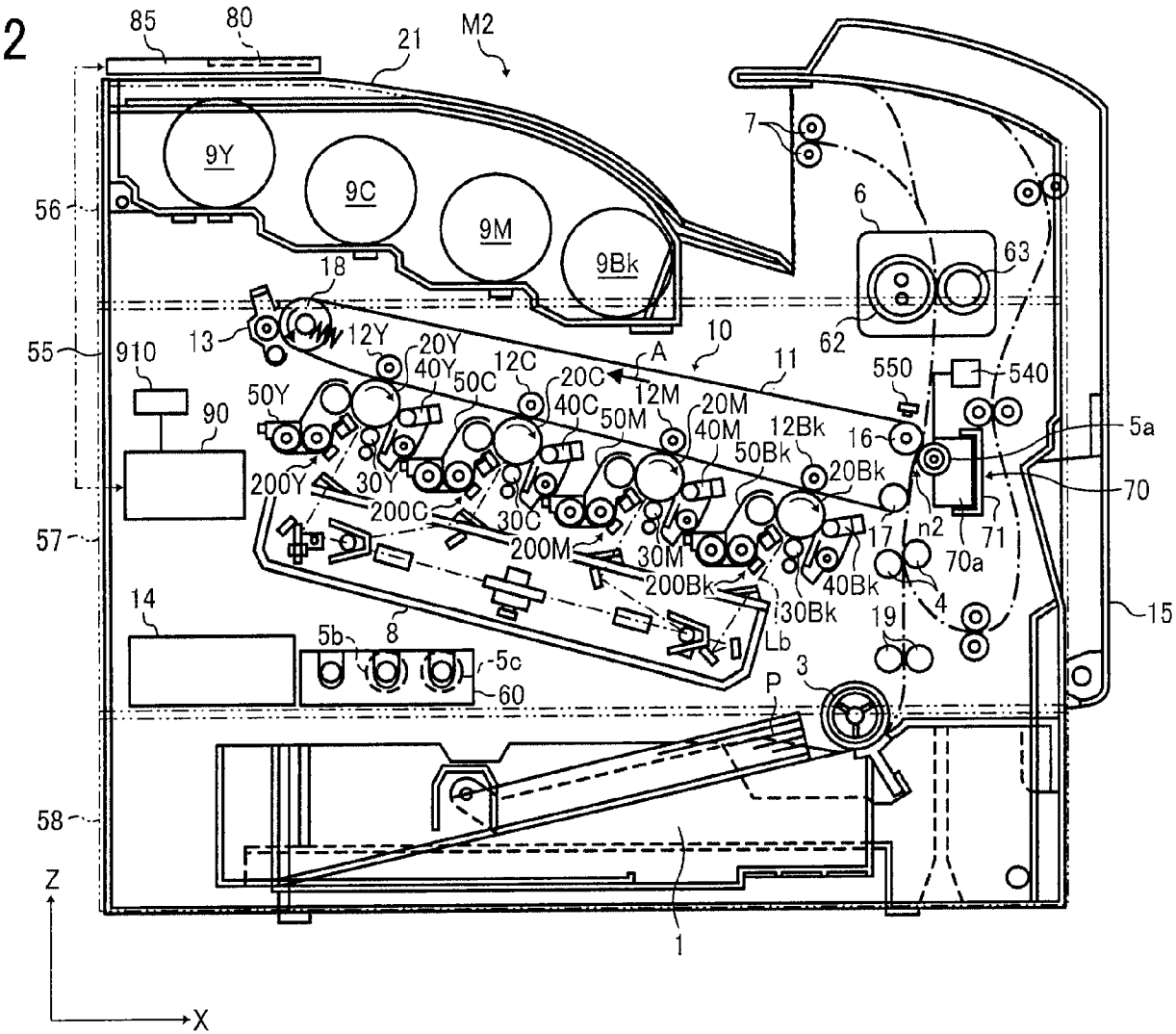
FIG. 12 is a schematic diagram illustrating a color printer as an example of the image forming apparatus according to another illustrative embodiment of the present invention.
Figure 13:
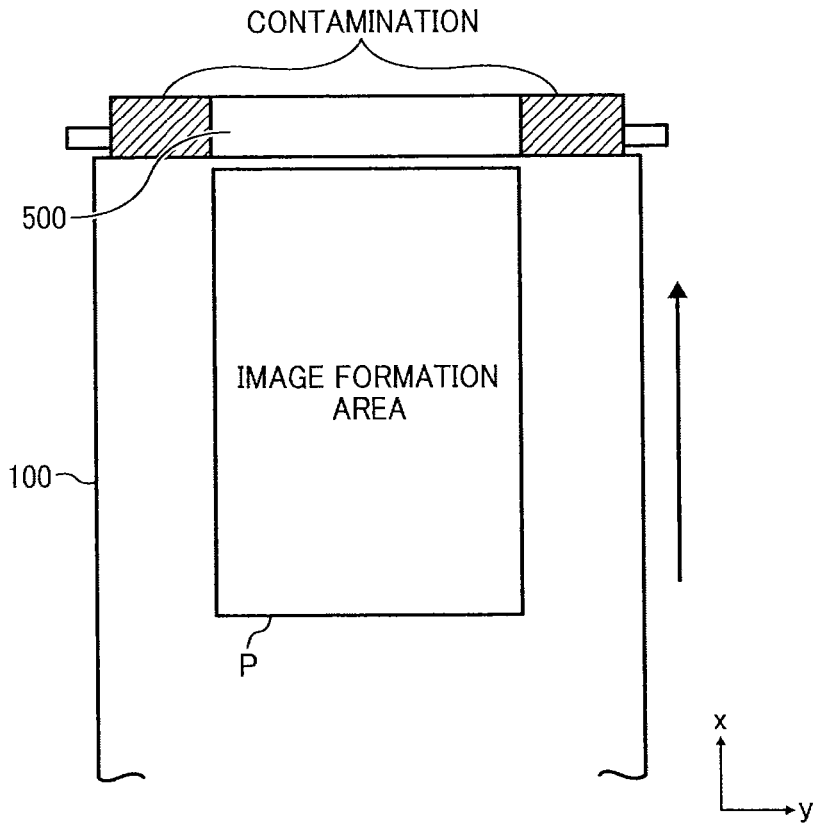
FIG. 13 RELATED ART
FIG. 13 is a schematic diagram illustrating a related-art transfer member and an intermediate transfer belt in a main scanning direction.

With reference to FIG. 12, a description is provided of an image forming apparatus M2 according to another illustrative embodiment of the present invention. It is to be noted that the same reference numerals used in FIG. 1 are provided to the similar or the same constituent elements in FIG. 12 when discrimination therebetween is not required.

According to the present illustrative embodiment, the image forming apparatus M2 as an example of a color printer includes the plurality of the secondary transfer rollers 5*a* through 5*c* which are detachably stored in a roller holder 60. One of the plurality of the secondary transfer rollers 5*a* through 5*c* in the roller holder 60 is selected as needed and attached manually to the roller support assembly 70*a*. Then, the secondary transfer roller 5 attached to the roller support assembly 70*a* mounted on the roller guide 71 of the secondary transfer unit 70 is installed in the image forming apparatus M2.

As illustrated in FIG. 12, as indicated by the double-dot-dash lines, the front side of the main body 55 of the image forming apparatus is surrounded by the upper outer frame 56 fixed to the upper portion of the main body 55, the center cover piece 57 below the upper outer frame 56, and the sheet cassette outer door 58. Below the center cover piece 57, the sheet cassette 1 which can be pulled out from the main body 55 is covered by the sheet cassette outer door 58. The roller holder 60 facing the center cover piece 57 is supported by the image forming apparatus main body 55 and disposed in the vicinity of the waste toner bin 14.

The center cover piece 57 can be opened upon maintenance of the inside of the main body 55 of the image forming apparatus M2, such as when the roller holder 60 is pulled out to change the secondary transfer roller 5.

Although not illustrated, secondary transfer rollers 5 that accommodate both portrait and landscape B4 and B5 sheets can be also installed in the secondary transfer unit 70. With this configuration, when, for example, requested by a user, the secondary transfer roller 5 having a different width in the main scanning direction can be replaced and mounted in the secondary transfer unit 70. The roller holder 60 stores the plurality of secondary transfer rollers 5 including the secondary transfer roller 5 having the width corresponding to the width of the recording medium that users use mainly, thereby facilitating replacement of the secondary transfer roller 5.

In this case, similar to the foregoing embodiments, the controller 90 adjusts the transfer roller bias and the secondary transfer current in accordance with the instruction provided by the setting changing device 85. The same or the similar effect as the foregoing embodiments can be achieved.

According to the illustrative embodiment with reference to FIG. 1, the plurality of secondary transfer rollers 5*a* through 5*c* including replacement rollers is held outside the image forming apparatus M1 and mounted selectively. By contrast, according to the illustrative embodiment with reference to FIG. 12, the image forming apparatus M2 is equipped with the roller holder 60 that stores the plurality of secondary transfer rollers 5*a* through 5*c*, one of which is selectively attached to the secondary transfer unit 70 manually.

Figure 11:
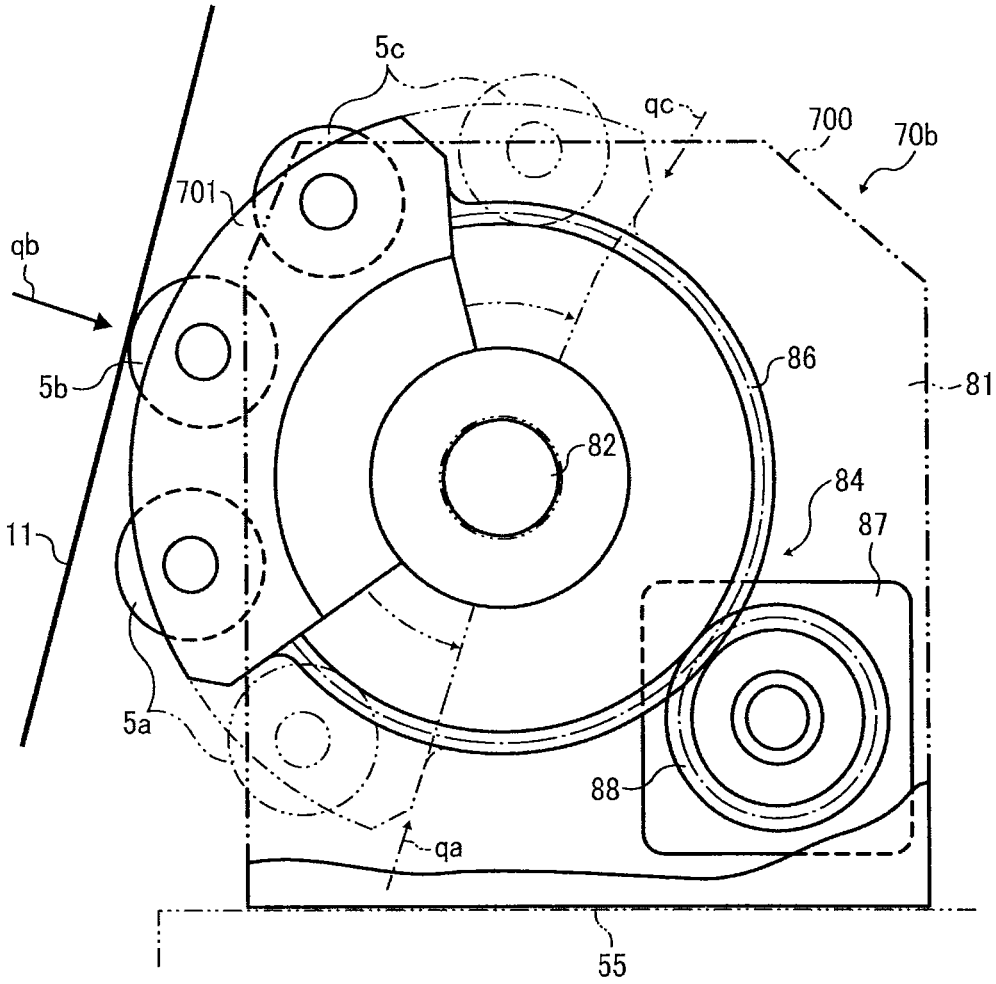
FIG. 11 is an enlarged side view of a switching assembly serving as a switching mechanism for changing the secondary transfer rollers according to another illustrative embodiment of the present invention.

Alternatively, as illustrated in FIG. 11, two or more secondary transfer rollers 5 having at least two different lengths in the main scanning direction are held by a switching assembly 700 in a secondary transfer unit 70*b*. The switching assembly 700 changes the position of the secondary transfer rollers 5 so that one of the secondary transfer rollers 5 is selectively employed for transfer.

With reference to FIG. 11, a detailed description is provided of the switching assembly 700 employed in the secondary transfer unit 70*b* according to yet another illustrative embodiment of the present invention. FIG. 11 is an enlarged side view of the switching assembly 700 in the secondary transfer unit 70*b*. It is to be noted that the secondary transfer unit 70*b* according to the present illustrative embodiment has the same configuration as the transfer unit 70 shown in FIG. 10, except the switching assembly 700. Thus, the description of the same constituent elements is omitted herein.

The switching assembly 700 includes a support shaft 82, a movable frame 701, the secondary transfer rollers 5*a* through 5*c* having three different widths in the main scanning direction, and a switching device 84. The support shaft 82 is supported by a support frame 81 at the image forming apparatus main body side. The movable frame 701 is rotatably supported by the support shaft 82. The secondary transfer rollers 5*a* through 5*b* are spaced apart and supported by the movable frame 701. The switching device 84 changes the position of the secondary transfer rollers 5*a* through 5*c* to transfer positions qa, qb, and qc at which the secondary transfer rollers 5*a* through 5*c* selectively contact the surface of the intermediate transfer belt 11.

According to the present illustrative embodiment, the both ends of the support shaft 82 are supported by the support frame 81 at the image forming apparatus main body side. The movable frame 701 has a fan-like shape and integrally supported at an intermediate part of the support shaft 82. The secondary transfer rollers 5*a* through 5*c* are disposed with a predetermined interval between each other and rotatably supported by the movable frame 701. More specifically, the secondary transfer rollers 5*a* through 5*c* are disposed at each of three positions of an evenly divided circumference of the movable frame 701 in the direction of movement thereof.

A fan-like shaped gear 86 is formed at the other end side of the movable frame 701. A driving gear 88 of a stepping motor 87 engages the gear 86.

Rotation of the stepping motor 87 enables the movable frame 701 to change selectively the position of the secondary transfer rollers 5*a* through 5*c* held by the movable frame 701 to the secondary transfer position (here, the position qb in FIG. 11). Prior to changing the position of the secondary transfer rollers 5*a* through 5*c*, the width of the recording medium stored in the sheet cassette 1 is detected. Based on the result and/or a user's request, one of the secondary transfer rollers 5*a* through 5*c* having the similar or the same width as the recording medium in the main scanning direction is selected as a target secondary transfer roller 5.

Subsequently, the stepping motor 87 is rotated to move the movable frame 701 to the positions qa, qb or qc such that the target secondary transfer roller 5 comes to the secondary transfer position qb.

In this case, the metal cored bar 510 of the secondary transfer rollers 5*a* through 5*c* is supplied with the predetermined bias voltage from the bias power source 540 to promote transfer process.

According to the present illustrative embodiment, the secondary transfer roller 5 corresponding to the size of the recording medium is selected and positioned not manually, but mechanically to the transfer position, for example, qb, by the switching assembly 700 with ease. Accordingly, the subsequent printing operation can be preformed promptly and easily.

According to an aspect of this disclosure, the present invention is employed in the image forming apparatus. The image forming apparatus includes, but is not limited to, an electrophotographic image forming apparatus, a copier, a printer, a facsimile machine, and a digital multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

an image forming mechanism to form a first image and a second image;

an image bearing member on a surface of which the image forming mechanism forms the first image and the second image;

a transfer member disposed facing the image bearing member and contactable thereagainst to form a transfer nip at which the first image is transferred from the image bearing member to a recording medium;

a transfer member mount on which the transfer member is disposed, accommodating multiple different sizes of transfer member; and an image detector to detect the second image on the surface of the image bearing member.

2. The image forming apparatus according to claim 1, wherein the transfer member comprises a plurality of interchangeable transfer members of different sizes, only one of which is disposed facing the image bearing member at any given time, including a first transfer member to contact the image bearing member except at an area at which the second image is formed and a second transfer member larger than the first transfer member to contact the image bearing member over an area including the area at which the second image is formed, wherein the second image is a test image for adjustment of image density.

3. The image forming apparatus according to claim 2, further comprising a transfer member holder to detachably store the plurality of transfer members.

4. The image forming apparatus according to claim 1, further comprising an electric field generator connected to the transfer member to form a first electric field that enables toner on the image bearing member to move to the recording medium while the recording medium is interposed between the image bearing member and the transfer member, and a second electric field opposite in polarity to the first electric field while no recording medium is interposed between the image bearing member and the transfer member.

5. The image forming apparatus according to claim 1, further comprising:

a mode selection device to select one of a first mode and a second mode; and a controller operatively connected to the mode selection device to cause the image forming mechanism to form the first image and the second image on the image bearing member based on the mode selected by the mode selection device, wherein in the first mode the image forming mechanism forms at least a portion of the second image at the same time as the first image, and in the second mode the image forming mechanism forms the second image at a different time from the first image.

6. The image forming apparatus according to claim 5, further comprising a storage device to store the mode selected by the mode selection device.

7. The image forming apparatus according to claim 1, further comprising a device detector to detect the length of the transfer member in a main scanning direction.

8. The image forming apparatus according to claim 7, wherein the device detector is a laser displacement detector.

9. The image forming apparatus according to claim 7, further comprising a reporting device indicating the size of a usable recording medium corresponding to the detected length of the transfer member in the main scanning direction detected by the device detector.

10. The image forming apparatus according to claim 9, further comprising a recording medium detector to detect the size of the recording medium, wherein operation of the image forming apparatus is interrupted in a case in which the length of the transfer member detected by the device detector does not correspond to the size of the recording medium detected by the recording medium detector.

11. An image forming apparatus, comprising:

a main body;

an image forming mechanism to form a first image and a second image;

an image bearing member on a surface of which the image forming mechanism forms the first image and the second image;

a plurality of interchangeable transfer members, only one of which at any given time is disposed facing the image bearing member and contactable thereagainst to form a transfer nip at which the first image is transferred from the image bearing member onto a recording medium, the plurality of transfer members comprising:

a first transfer member to contact the image bearing member except an area at which the second image is formed; and a second transfer member larger than the first transfer member to contact the image bearing member including over an area at which the second image is formed;

an image detector to detect the second image on a surface of the image bearing member; and a transfer member switching device to switch between the first transfer member and the second transfer member.

12. The image forming apparatus according to claim 11, wherein the transfer member switching device comprises:

a support shaft to support the transfer member switching device at the main body of the image forming apparatus;

a movable frame rotatably supported by the support shaft; and a switching mechanism to switch the transfer members, such that only one of the transfer members contacts the image bearing member at any given time, wherein the transfer members have different lengths in a main scanning direction.

13. The image forming apparatus according to claim 12, wherein the transfer members are disposed equidistantly along the movable frame.

* * * * *